United States Patent [19]

Gilbert

[11] 4,278,255

[45] Jul. 14, 1981

[54] BOARD GAME APPARATUS

[76] Inventor: Harold J. Gilbert, 1900 Randolph Rd., Ste. 402, Charlotte, N.C. 28207

[21] Appl. No.: 89,232

[22] Filed: Oct. 29, 1979

[51] Int. Cl.[3] ..... A63F 3/00

[52] U.S. Cl. ..... 273/248

[58] Field of Search ..... 273/248, 249, 258, 243

[56] References Cited

U.S. PATENT DOCUMENTS

| | | | |
|---|---|---|---|
| 1,883,651 | 10/1932 | Ensley | 273/248 X |
| 2,756,053 | 7/1956 | Wales | 273/258 |
| 4,089,527 | 5/1978 | Roth | 273/249 |

FOREIGN PATENT DOCUMENTS

| | | | |
|---|---|---|---|
| 594659 | 9/1925 | France | 273/243 |

*Primary Examiner*—Richard C. Pinkham
*Assistant Examiner*—Scott L. Brown
*Attorney, Agent, or Firm*—Bell, Seltzer, Park and Gibson

[57] ABSTRACT

This invention relates to a board game apparatus of the type wherein each player moves a plurality of playing pieces over the playing board from respective designated starting spaces to corresponding designated destination spaces. Located between the starting spaces and the destination spaces is a grid of longitudinally and laterally contiguous playing spaces, with certain of the playing spaces being designated as "safe" spaces for each player, and with the safe spaces for one player differing from those of another player. The safe spaces are so arranged that a player can take a relatively direct but unsafe path from his starting space to his destination space, or if desired, he can take a somewhat longer but safer path from his starting space to his destination space.

8 Claims, 3 Drawing Figures

BOARD GAME APPARATUS

FIELD OF THE INVENTION

This invention relates to a board game apparatus, and in particular to a board game apparatus of the type wherein each player moves a plurality of playing pieces over the playing board from a designated starting location to a designated destination.

BACKGROUND OF THE INVENTION

A large number of the board games which have been heretofore developed are based upon some theme, such as travel, war, detectives, real estate transactions, etc. A fundamental aspect of such games involves reading and following instructions which appear either on the game board itself or on cards which are used in connection with the playing of the game. Consequently, such games are limited in their applicability and cannot be used and enjoyed by persons who cannot read or persons who read a language different from that used on the game. While board games have been developed which do not require an ability to read, most of these are pre-school or juvenile games which rely primarily on chance and do not present much of an opportunity for the use of strategy. Consequently, such games are of limited age appeal.

Board games which do not rely upon reading, and which also present the opportunity for the application of strategy in addition to mere chance, have been relatively few in number. However, the prior games which have possessed these attributes have generally been quite successful and enduring. By way of example, reference may be made to Checkers, Parchesi, Backgammon, and Chinese Checkers.

SUMMARY OF THE INVENTION

The board game of the present invention, like the board games just mentioned, is of a type which does not require an ability to read and which is interesting and appealing to players of a wide range of ages. Further, the rules of the game are relatively simple and can be learned quite quickly. While the game is played with a chance device, such as dice, the game provides considerable opportunity for the exercise of strategy in the play of the game and thus the game can be played and enjoyed by persons of various ages and various levels of skill.

The present invention, more particularly, is designed for play by a plurality of players and utilizes a playing board having four sides and a playing surface thereon. Means is provided along one side of the playing board defining on the playing surface a plurality of individual starting spaces for each of the players. The number of starting spaces for each player is the same. Means is provided along the opposite side of the playing board defining on the playing surface a plurality of individual destination spaces for each of the players, with the destination spaces corresponding in number to the number of starting spaces. A distinctive visually discernible first characteristic, such as color for example, is associated with the respective starting spaces and destination spaces of each player for identifying the starting spaces and destination spaces as belonging to a particular player while distinguishing such starting spaces and destination spaces from those belonging to the other players.

Distinctive visually discernible second characteristics, such as numbers or shapes for example, are associated with the respective individual starting spaces of the players for identifying each individual starting space and distinguishing it from other starting spaces of that same player. Corresponding numbers, shapes or the like are associated with the respective destination spaces of the players for identifying a corresponding destination space for each starting space.

Each player is provided with a set of playing pieces, the playing pieces corresponding in number to the number of individual starting spaces. Each player's playing pieces display the distinctive first characteristic, e.g. color, of that player for thereby identifying the playing pieces as belonging to a particular player while distinguishing such playing pieces from those of the other players. Additionally, each playing piece of the player's set of playing pieces is identified by a visually discernible second characteristic, e.g. number or shape corresponding to those used on the starting spaces for thus identifying each individual playing piece and distinguishing it from the other playing pieces of that same player and for also identifying the particular starting space and destination space applicable to that playing piece.

A grid of longitudinally and laterally contiguous playing spaces is provided on the playing surface extending between the starting spaces and the destination spaces, and over which the playing pieces are advanced during the play of the game in attempting to proceed from the starting spaces to the destination spaces. A significant feature of this game is that certain ones of the playing spaces have the distinctive visually discernible first characteristic, e.g. color, of one of the players to thereby define those playing spaces as "safe" spaces for a player whose playing pieces are of that same color, but which is not a safe space for players whose playing pieces are of a different color.

Finally, the board game apparatus includes a chance device, such as dice, for indicating the number of playing spaces for a player to move his playing pieces in attempting to advance the playing pieces from the starting space to the destination space.

BRIEF DESCRIPTION OF THE DRAWINGS

Some of the features and advantages of the invention having been stated, others will become apparent as the description proceeds when taken in connection with the accompanying drawings, in which.

DESCRIPTION OF ILLUSTRATED EMBODIMENT

Figure 1:
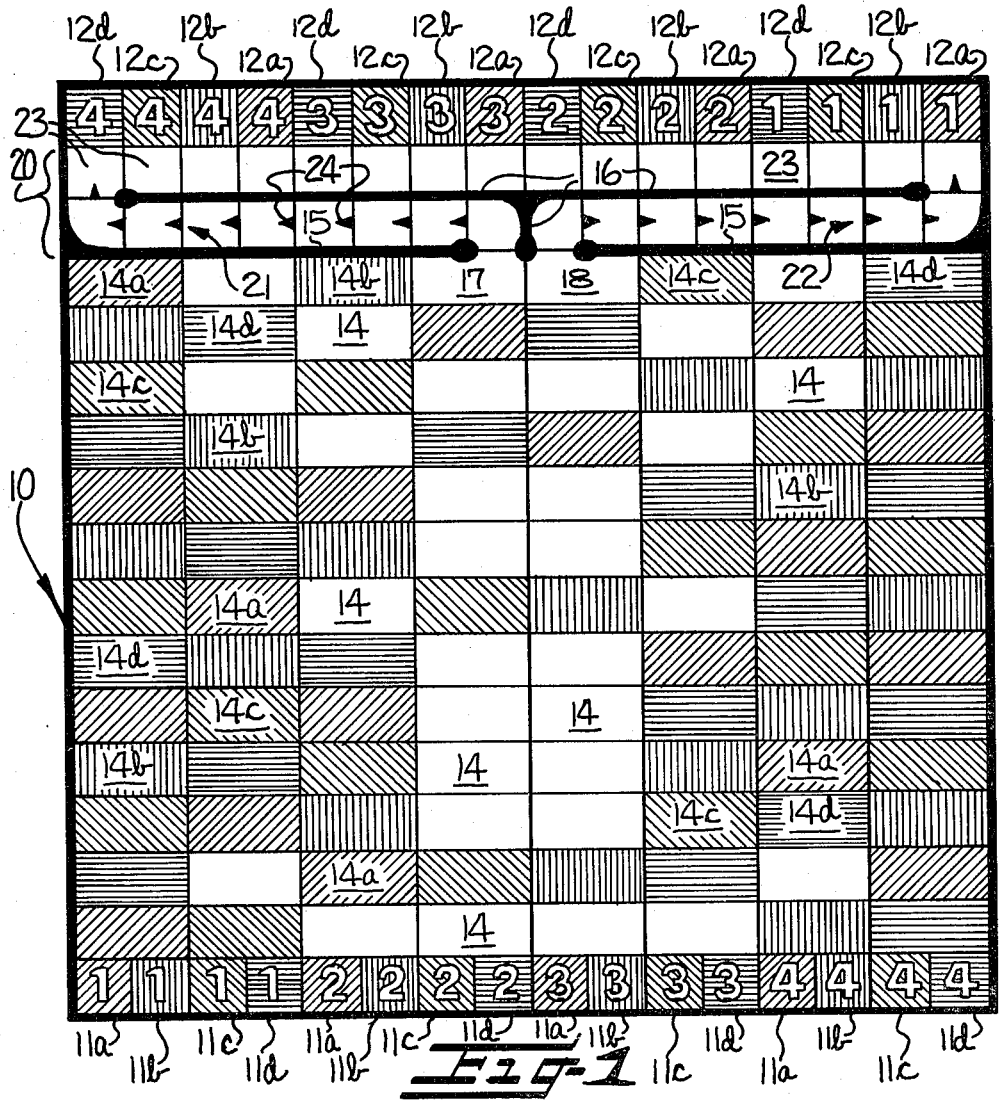
FIG. 1 is a plan view showing a playing board in accordance with the invention, with certain of the spaces thereon being lined to indicate colors and with the unlined spaces representing white spaces.

Referring now to the drawings and to FIG. 1 in particular, the game apparatus of this invention includes a rectangular playing board 10 having four sides and a playing surface on which is provided, by printing or the like, suitable indicia as will be described presently. Along one side of the board there is provided a series of contiguous squares, identified by the reference characters 11*a*, 11*b*, 11*c*, and 11*d* serving to define a plurality of individual starting spaces for each of the players. In the illustrated embodiment, the board game is designed for two to four players and each player is provided with four individual starting spaces.

Along the side of the board opposite the starting spaces there is provided a corresponding row of contiguous squares which serve to define destination spaces corresponding to each of the starting spaces, the destination spaces being identified by the reference characters 12*a*, 12*b*, 12*c* and 12*d*.

The starting spaces and destination spaces for each player are identified by a distinctive visually discernible first characteristic. In the preferred embodiment of the invention illustrated herein the starting spaces and destination spaces of each player are identified by a distinctive color. Thus, as illustrated, the starting spaces 11*a* and destination spaces 12*a* of one player are lined for yellow, while the starting spaces 11*b* and corresponding destination spaces 12*b* for a second player are lined for red. The starting spaces 11*c* and corresponding destination spaces 12*c* are lined for green, while the starting spaces 11*d* and corresponding destination spaces 12*d* for a fourth player are lined for brown. It should be understood that other visually discernible characteristics besides color could be used for identifying the spaces of the respective players.

In order to identify each individual starting space of a player and distinguish it from other starting spaces of that same player, each individual starting space is also identified by a visually discernible second characteristic. Thus, in the preferred embodiment of the invention illustrated herein, the respective starting spaces 11*a*, 11*b*, 11*c*, and 11*d*, are additionally identified by printed indicia in the form of the numbers 1–4. However, other distinctive characteristics could be employed, such as indicia representing letters of the alphabet, shapes, or representations of various objects for example. The respective destination spaces of each player are similarly identified by a visually discernible second characteristic, which in the illustrated embodiment are the numerals 1–4.

As illustrated, the arrangement of the destination spaces is the inverse of that of the starting spaces, with the destination spaces thus being arranged diagonally opposite the corresponding starting spaces. For example, the yellow player's number 1 starting space, which is identified by the reference character 11*a* and by the numeral 1 and located in the lower left-hand corner of the playing board illustrated in FIG. 1, with the corresponding destination space for this particular starting space being located in the upper right-hand corner and identified by the reference character 12*a* and by the numeral 1. The arrangement of the starting spaces is such that each player's four playing pieces are distributed at spaced locations across the board, with the correspondingly numbered playing pieces of each player being grouped together.

Figure 2:
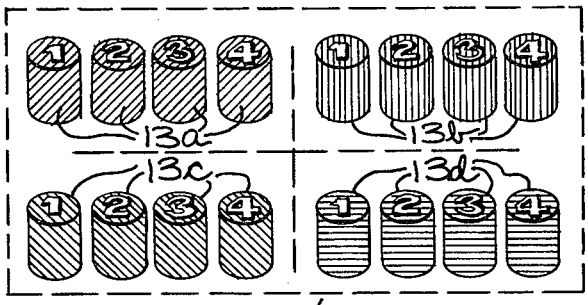
FIG. 2 illustrates the sets of playing pieces for each player.

The game apparatus also includes a set of playing pieces for each player, identified in FIG. 2 by the reference characters 13*a*, 13*b*, 13*c* and 13*d*. The playing pieces of each player are identified by the distinctive visually discernible first characteristic, i.e. color, of that player. Thus, the yellow player, whose starting spaces are identified by the reference character 11*a* and whose destination spaces are identified by the reference character 12*a*, has playing pieces 13*a* which are also identified by the color yellow. Additionally, each individual playing piece is identified by a distinctive visually discernible second characteristic, which in the illustrated embodiment are the numerals 1–4. Where the second characteristic used on the starting spaces and destination spaces is printed indicia in the form of a shape or a representation of an object, the playing pieces may be in the form of that shape or object. The numerals 1–4 on the playing pieces correspond to those used on the starting spaces and serve to identify each individual playing piece of a player and distinguish it from the other playing pieces of that same player and to also indicate the particular starting space and destination space which is applicable to a particular playing piece. Thus, the yellow playing piece 13*a* which bears the numeral 1 will use the yellow starting space 11*a* having the numeral 1, which in FIG. 1 is located in the lower left-hand corner of the playing board. This playing piece would have the yellow destination space 12*a* also bearing the numeral 1. This destination space is located in the upper right-hand corner of the playing board of FIG. 1.

Located between the row of starting spaces 11*a*–11*d* and the row of destination spaces 12*a*–12*d*, is a grid of longitudinally and laterally contiguous playing spaces, identified by the reference characters 14, 14*a*, 14*b*, 14*c* and 14*d*. As illustrated, the playing spaces are of a rectangular shape and about twice the size of the individual starting spaces and destination spaces. Certain ones of the playing spaces are identified by colors corresponding to the colors of the players, while other playing spaces are white or uncolored. The reference character 14 identifies the uncolored spaces, while the reference characters 14*a*–14*d* indicate playing spaces having colors corresponding to the colors of the individual players. The colored playing spaces 14*a*–14*d* serve to define those playing spaces as safe spaces for a player whose playing piece is of that same color. However, those spaces are not a safe space to a player whose color does not match the color of the space. Similarly, an uncolored or white space 14 is not safe for any player. As illustrated, the safe spaces are concentrated adjacent the sides of the playing board, with relatively few safe spaces being located in the medial portion of the board. This serves to enhance the strategy of the game by allowing a player to take a relatively direct but unsafe path from his starting space to his destination, or if desired, to take a somewhat longer but safer path from his starting space to his destination space.

Means is provided adjacent the destination spaces defining inner and outer partitions, 15, 16, respectively, located forwardly of and extending generally parallel to the row of destination spaces. The partition 15 has a medial opening forming an entranceway into a danger zone 20 located behind the partition 15. Two playing spaces, identified by the reference characters 17 and 18 are located immediately adjoining the entranceway, and a player must pass over one of these two playing spaces 17, 18 in order to enter the danger zone 20 and reach his destination space. The danger zone 20 is divided by partition 16 into a pair of alternate pathways 21, 22 which lead from the spaces 17 and 18, around opposite ends of the inner partition 16, and ultimately to the destination spaces, the pathways being divided into individual relatively small playing spaces 23. Thus, all of the players must enter one of the two entranceway spaces indicated at 17 and 18 and proceed along one of the two alternate pathways 21, 22 to the particular destination space corresponding to that playing piece.

Figure 3:
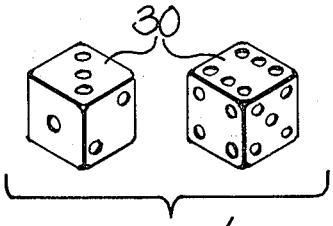
FIG. 3 illustrates a pair of dice for use in playing the game.

The game apparatus also includes a chance device, such as a pair of dice 30 (FIG. 3) for determining the movement of the playing pieces.

METHOD OF PLAY

Play is begun by arranging the respective playing pieces 13*a*–13*d* on their corresponding starting spaces 11*a*–11*d*. The winner is the first player who moves all of his playing pieces to their respective destination spaces located at the opposite side of the playing board. One player is selected to go first, and then each player takes a turn thereafter. Each player rolls the dice, and must move two pieces each turn. One piece must be moved the exact number indicated by one die, and another playing piece must be moved the exact number of the other die. Any time a player's piece lands by exact count on the same space where an opposing player's piece rests, the opposing player's piece is returned to its original starting space. However, any piece resting on a space of the same color, for example a yellow piece on a yellow playing space, is safe and cannot be sent back to the starting point. No two pieces of the same or different color may rest on the same space. Passing a playing piece, but not landing on his playing space, is permitted but does not send the opposing player's piece back to the starting point.

Pieces may be moved forward and horizontally but not backward nor diagonally. A piece may be moved in any manner in these two directions as long as it is not moved immediately back to the same space from which it just left.

All pieces must enter one of the spaces identified by the reference character 17 or 18 and proceed along one of the two common pathways 21, 22 in the direction indicated by the small directional indicators 24. Once a piece is moved from the main playing area onto one of the two pathways, the playing piece must continue to move in that direction until it reaches its particular destination space. The playing piece may not go past its destination space, and it must enter the destination space by exact count. Passing another playing piece in this pathway area is permitted, and pieces must be returned to their original starting space when an opposing player's piece lands on the space occupied by another player's piece.

While a specific embodiment of the invention has been illustrated and described herein, it is to be clearly understood that the invention is not to be limited to the exact constructions and rules illustrated and described, since it can be seen that various modifications of these details may be provided in practicing the invention.

That which is claimed is:

1. A game apparatus for a plurality of players comprising, in combination, a playing board having four sides and a playing surface, means along one side of the playing board defining on said playing surface a plurality of individual starting spaces for each of the players, the number of starting spaces for each player being the same, means along the opposite side of the playing board defining on the playing surface a plurality of individual destination spaces for each of the players, said destination spaces corresponding in number to the number of starting spaces, means defining a visually discernible first characteristic associated with the respective starting spaces and destination spaces of each player for identifying the starting spaces and destination spaces as belonging to a particular player while distinguishing such starting spaces and destination spaces from those belonging to the other players, means defining distinctive visually discernible second characteristics associated with the respective individual starting spaces of each player for identifying each individual starting space of a player and distinguishing it from the other starting spaces of that same player, means defining corresponding visually discernible second characteristics associated with the respective destination spaces of each player for identifying a corresponding destination space for each starting space, a set of playing pieces for each player, said playing pieces corresponding in number to the number of individual starting spaces, said distinctive visually discernible first characteristic being associated with the playing pieces of each set for identifying the playing pieces as belonging to a particular player while distinguishing such playing pieces from those of the other players, said distinctive visually discernible second characteristic also being associated with the playing pieces of each set of identifying each individual playing piece and distinguishing it from the other playing pieces of that same player and for also identifying the particular starting space and destination space applicable to that playing piece, means on said playing surface defining a grid of longitudinally and laterally contiguous playing spaces between said starting spaces and said destination spaces, partition means located on said playing surface between said starting spaces and said destination spaces and having a pair of openings therein through which the playing pieces must pass in order to reach said destination spaces, respective individual pathways leading from each of said openings to said destination spaces, said distinctive visually discernible first characteristic for each player also being associated with certain ones of said playing spaces and serving to define those playing spaces as safe spaces for a player whose playing piece is of that same first characteristic but which is not a safe space for players whose playing pieces are of a different first characteristic, and a chance device for indicating the number of playing spaces for a player to move his playing pieces in attempting to advance the playing pieces from the starting space to the destination space.

2. A game apparatus as set forth in claim 1 wherein the playing spaces having said visually discernible first characteristic are less than the total number of playing spaces on the playing board.

3. A game apparatus as set forth in claim 2 wherein more of said playing spaces having said visually discernible first characteristics are located adjacent the side edges of the playing board than are located adjacent the medial portions of the playing board.

4. A game apparatus as set forth in claim 2 wherein the playing spaces having said visually discernible first characteristic are equal in number for all players.

5. A game apparatus as set forth in claim 2 wherein said playing spaces having said visually discernible first characteristic are symmetrically distributed on opposite sides of a line of symmetry extending medially of the playing board from the side having said starting spaces to the opposite side having said destination places.

6. A game apparatus as set forth in claim 1 wherein said visually discernible first characteristic comprises color.

7. A game apparatus as set forth in claim 1 wherein said visually discernible second characteristics comprise printed indicia.

8. A game apparatus for a plurality of players comprising, in combination, a playing board having four sides and a playing surface, means along one side of the playing board defining on said playing surface a plurality of individual starting spaces for each of the players, the number of starting spaces for each player being the same, means along the opposite side of the playing board defining on the playing surface a plurality of individual destination spaces for each of the players, said destination spaces corresponding in number to the number of starting spaces, means defining a visually discernible first characteristic associated with the respective starting spaces and destination spaces of each player for identifying the starting spaces and destination spaces as belonging to a particular player while distinguishing such starting spaces and destination spaces from those belonging to the other players, means defining distinctive visually discernible second characteristics associated with the respective individual starting spaces of each player for identifying each individual starting space of a player and distinguishing it from the other starting spaces of that same player, means defining corresponding visually discernible second characteristics associated with the respective destination spaces of each player for identifying a corresponding destination space for each starting space, a set of playing pieces for each player, said playing pieces corresponding in number to the number of individual starting spaces, said distinctive visually discernible first characteristic being associated with the playing pieces of each set for identifying the playing pieces as belonging to a particular player while distinguishing such playing pieces from those of the other players, said distinctive visually discernible second characteristics also being associated with the playing pieces of each set for identifying each individual playing piece and distinguishing it from the other playing pieces of that same player and for also identifying the particular starting space and destination space applicable to that playing piece;

means on said playing surface defining a grid of longitudinally and laterally contiguous playing spaces between said starting spaces and said destination spaces, partition means located on said playing surface between said starting spaces and said destination spaces and having a medially located opening therein through which all playing pieces must pass in order to reach said destination spaces, said distinctive visually discernible first characteristic for each player also being associated with certain ones of said playing spaces and serving to define those playing spaces as safe spaces for a player whose playing piece is of that same first characteristic but which is not a safe space for players whose playing pieces are a different first characteristic, said certain ones of said playing spaces having said visually discernible first characteristic being less than the total number of playing spaces on the board and being generally symmetrically distributed on opposite sides of a line of symmetry extending medially of the playing board from the side of the playing board having said starting spaces to the opposite side having said destination spaces, and with more of said certain ones of said playing spaces being located adjacent the side edges of the playing board than are located adjacent the medial portions of the playing board so that a player can take a relatively direct but unsafe path from his starting space to his destination space, or if desired, he can take a somewhat longer but safer path from his starting space to his destination space, and a chance device for indicating the number of playing spaces for a player to move his playing pieces in attempting to advance the playing pieces from the starting space to the destination space.

* * * * *

UNITED STATES PATENT AND TRADEMARK OFFICE

CERTIFICATE OF CORRECTION

PATENT NO. : 4,278,255

DATED : July 14, 1981

INVENTOR(S) : Harold J. Gilbert

It is certified that error appears in the above-identified patent and that said Letters Patent are hereby corrected as shown below:

Column 3, line 34, "numbers" should be --numerals--.

Column 6, line 26, "of" (second occurrence) should be --for--.

Signed and Sealed this

*Twentieth* Day of *October 1981*

[SEAL]

*Attest:*

GERALD J. MOSSINGHOFF

*Attesting Officer*

*Commissioner of Patents and Trademarks*